US011499120B2

(12) United States Patent
Calderon et al.

(10) Patent No.: US 11,499,120 B2
(45) Date of Patent: Nov. 15, 2022

(54) THREE POLYMER BLEND TO ACHIEVE FABRIC CARE IN LAUNDRY

(71) Applicant: Henkel AG & Co. KGaA, Duesseldorf (DE)

(72) Inventors: Alma D. Calderon, Derby, CT (US); Wei Sun, Trumbull, CT (US); Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 6 days.

(21) Appl. No.: 16/777,147

(22) Filed: Jan. 30, 2020

(65) Prior Publication Data

US 2021/0238501 A1 Aug. 5, 2021

(51) Int. Cl.

| | |
|---|---|
| ***C11D 3/22*** | (2006.01) |
| ***C11D 1/83*** | (2006.01) |
| ***C11D 1/831*** | (2006.01) |
| ***C11D 3/00*** | (2006.01) |
| ***C11D 3/04*** | (2006.01) |
| ***C11D 3/20*** | (2006.01) |
| ***C11D 3/30*** | (2006.01) |
| ***C11D 3/34*** | (2006.01) |
| ***C11D 17/04*** | (2006.01) |
| ***C11D 1/722*** | (2006.01) |
| ***C11D 1/12*** | (2006.01) |
| ***C11D 1/14*** | (2006.01) |
| ***C11D 3/37*** | (2006.01) |
| *C11D 1/22* | (2006.01) |
| *C11D 1/29* | (2006.01) |
| *C11D 1/72* | (2006.01) |

(52) U.S. Cl.

CPC ..... *C11D 3/222* (2013.01); *C11D 1/12* (2013.01); *C11D 1/14* (2013.01); *C11D 1/722* (2013.01); *C11D 1/83* (2013.01); *C11D 1/831* (2013.01); *C11D 1/8305* (2013.01); *C11D 3/0021* (2013.01); *C11D 3/0026* (2013.01); *C11D 3/0036* (2013.01); *C11D 3/046* (2013.01); *C11D 3/2086* (2013.01); *C11D 3/30* (2013.01); *C11D 3/349* (2013.01); *C11D 3/3753* (2013.01); *C11D 3/3757* (2013.01); *C11D 3/3773* (2013.01); *C11D 3/3792* (2013.01); *C11D 17/042* (2013.01); *C11D 17/043* (2013.01); *C11D 1/22* (2013.01); *C11D 1/29* (2013.01); *C11D 1/72* (2013.01)

(58) Field of Classification Search

CPC .. C11D 1/72; C11D 1/722; C11D 1/83; C11D 1/22; C11D 1/12; C11D 1/14; C11D 1/29; C11D 3/30; C11D 3/3753; C11D 3/3757; C11D 3/3792; C11D 3/3773; C11D 17/043

USPC ..... 510/421, 340, 351, 352, 356, 357, 360, 510/475, 499, 504, 505, 506

See application file for complete search history.

(56) References Cited

U.S. PATENT DOCUMENTS

| | | | | |
|---|---|---|---|---|
| 7,576,048 | B2 | 8/2009 | Gray et al. | |
| 9,834,682 | B2 * | 12/2017 | Torres | C11D 3/40 |
| 2005/0124528 | A1 | 6/2005 | Binder et al. | |
| 2006/0030513 | A1 | 2/2006 | Binder et al. | |
| 2006/0217287 | A1 * | 9/2006 | Zhu | C11D 3/227 510/515 |
| 2006/0223739 | A1 | 10/2006 | Zhu et al. | |
| 2011/0252576 | A1 * | 10/2011 | Boutique | C11D 1/83 8/137 |
| 2015/0099684 | A1 * | 4/2015 | Boutique | C11D 17/046 510/293 |
| 2015/0203796 | A1 | 7/2015 | Miracle et al. | |
| 2015/0275135 | A1 * | 10/2015 | Si | C11D 3/3773 510/341 |
| 2017/0066997 | A1 * | 3/2017 | Chen | C11D 3/3773 |
| 2018/0179477 | A1 * | 6/2018 | Ure | C11D 3/3723 |
| 2019/0112558 | A1 * | 4/2019 | Miracle | C11D 3/40 |
| 2019/0233768 | A1 | 8/2019 | Piorkowski et al. | |

FOREIGN PATENT DOCUMENTS

| | | | | |
|---|---|---|---|---|
| WO | 2007120547 | A1 | 10/2007 | |
| WO | WO-2007120547 | A1 * | 10/2007 | C11D 3/2079 |
| WO | 2010072628 | A1 | 7/2010 | |
| WO | 2014079621 | A1 | 5/2014 | |

OTHER PUBLICATIONS

European Patent Office, European Search Report, EP 21 15 4354 dated Jun. 23, 2021, pp. 1-11, Munich, Germany.

* cited by examiner

*Primary Examiner* — Gregory R Delcotto
(74) *Attorney, Agent, or Firm* — Bojuan Deng

(57) ABSTRACT

The present disclosure provides liquid and unit dose laundry detergent compositions. Provided herein is a laundry detergent composition including: (a) at least one anionic surfactant, (b) at least one non-ionic surfactant, (c) at least one cationic cellulosic polymer, (d) at least one dye transfer inhibitor polymer, (e) at least one anti-redeposition polymer, and (f) water. The present disclosure also provides a unit dose laundry detergent product including: a water-soluble polymeric film; a detergent composition encapsulated by the water-soluble polymeric film, the detergent composition including: (a) at least one anionic surfactant, (b) at least one non-ionic surfactant, (c) at least one cationic cellulosic polymer, (d) at least one dye transfer inhibitor polymer, (e) at least one anti-redeposition polymer, and (g) water. Methods of making and using the disclosed laundry detergent compositions are also provided.

19 Claims, No Drawings

THREE POLYMER BLEND TO ACHIEVE FABRIC CARE IN LAUNDRY

FIELD OF THE INVENTION

The present disclosure relates to a three polymer blend for fabric care. More specifically, the present disclosure relates to a composition including a combination of three polymers which provide fabric care benefits to laundry.

BACKGROUND OF THE INVENTION

A number liquid laundry detergents that are currently available to consumers for use in a standard washing machine, can adequately clean and freshen, e.g., with fragrance, the washed laundry. However, many consumers prefer that their laundry detergent provides benefits to laundry in addition to cleaning and freshening.

The term "fabric care," relates to various fabric benefits including smoothness, shape maintenance, resilience, color preservation, pilling control, and others. Consumers may desire that their cleaned and freshened laundry is provided with any number of these benefits, and others.

Attempts have been made to address this need. For example, it has been found that the addition of cationic cellulosic polymers to laundry detergents can provide some fabric care benefits. However, the use of such polymers may have no effect on fabric resilience.

Accordingly, there is a need for laundry detergent compositions that can provide the fabric care benefits of cationic cellulosic polymers while avoiding the drawbacks described above. The three polymer blend compositions described herein meets this need.

BRIEF SUMMARY OF THE INVENTION

In some aspects, the present disclosure provides a laundry detergent composition, comprising: (a) at least one anionic surfactant present in the composition in a concentration of about 2% to about 30% (w/w); (b) at least one non-ionic surfactant present in the composition in a concentration of about 2% to about 30% (w/w); (c) at least one cationic cellulosic polymer present in the composition in a concentration of from about 0.05% to about 2.0%; (d) at least one dye transfer inhibitor polymer present in the composition in a concentration of about 0.05% to about 2.0% (w/w); (e) at least one anti-redeposition polymer present in the composition in a concentration of from about 0.05% to about 2.0% (w/w), and (f) water present in the composition in a concentration of about 30% to about 95% (w/w).

In some aspects, the at least one anionic surfactant is selected from the group consisting of alkylbenzene sulfonic acids, alkyl ether sulfates, polyethoxylated alcohol sulfates, sodium lauryl ether sulfates, alkali metal salts of $C_{10}$-$C_{16}$ alkyl benzene sulfonic acids, linear alkyl benzene sulfonates, sodium and potassium linear, straight chain alkylbenzene sulfonates, and α-sulfofatty acid esters, ethoxysulfates, such as, for example, C12-15 ethoxysulfate (alcohol ethoxysulfate) 3EO, and combinations thereof.

In some aspects, the non-ionic surfactant is selected from the group consisting of alkoxylated fatty alcohols, ethylene oxide (EO)-propylene oxide (PO) block polymers, amine oxide surfactants, alcohol alkoxylates, $C_{12}$-$C_{15}$ alcohol ethoxylates, ethoxylated or ethoxylated and propoxylated, fatty acid alkyl esters, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides.

In some aspects, the at least one cationic cellulosic polymer is a cationic hydroxyethyl cellulose polymer.

In some aspects, the at least one dye transfer inhibitor polymer is selected from the group consisting of poly-N-vinylpyrrolidone (PVP), poly-4-vinylpyridine-N-oxide (PVNO), N-vinylpyrrolidone and N-vinylimidazole (PVPVI), or their copolymers, and mixtures thereof.

In some aspects, the at least one anti-redeposition polymer is selected from the group consisting of polyacrylate, polymethylacrylate, methylacrylate styrene copolymers, sodium methylacrylate styrene copolymers, and mixtures thereof.

In some aspects, the disclosed compositions further comprise a de-foaming agent, selected from the group consisting of fatty acids derived from palm kernel oil or coconut oil, wherein the de-foaming agent is present in the composition in a concentration of from about 0.10% to about 5.0% (w/w).

In some aspects, the disclosed compositions further comprise citric acid, wherein the citric acid is present in the composition in a concentration of about 0.5% to about 7.0% (w/w).

In some aspects, the disclosed compositions further comprise sodium hydroxide (caustic) wherein the sodium hydroxide (caustic) is present in the composition in a concentration of about 0.01% (w/w), or about 0.05% (w/w).

In some aspects, the disclosed compositions further comprise triethanolamine (TEA), wherein the TEA is present in the composition in a concentration of from about 0.50% to about 1.5% (w/w).

In some aspects, the disclosed compositions further comprise calcium chloride, wherein the calcium chloride is present in the composition in a concentration of from about 0.01% (w/w) to about 0.05% (w/w).

In some aspects, the disclosed compositions further comprise a chelating agent, wherein the chelating agent is present in the composition in a concentration of from about 0.3% to about 0.5% (w/w).

In some aspects, the disclosed compositions further comprise monoethanolamine, wherein the monoethanolamine is present in the composition in a concentration of from about 0.5% to about 1.5% (w/w).

In some aspects, the disclosed compositions further comprise a preservative selected from the group consisting of 5-chloro-2-methyl-2H-isothiazol-3-one and 2-methyl-2H-isothiazol-3-one (CMIT/MIT), benzisothiazolinone (BIT), 2-methyl-4-isothiazolin-3-one, 5-chloro-2-methyl-4-isothiazolin-3-one, 2-methyl-4-isothiazolin-3-one, and combinations thereof, wherein the preservative is present in the composition in a concentration of from 0.001% to about 0.15% (w/w).

In some aspects, the disclosed compositions further comprise a fragrance, wherein the fragrance is present in the composition in a concentration of from 0.10% (w/w) to about 3.0% (w/w).

In some aspects, the present disclosure provides a laundry detergent composition comprising: at least one cationic cellulosic polymer in a concentration of from about 0.1% to about 0.75% (w/w); at least one dye transfer inhibitor in a concentration of from about 0.1% to about 0.75% (w/w); and at least one anti-redeposition agent in a concentration of from about 0.1% to about 0.85% (w/w); and further comprising at least one additional beneficial agent.

In some aspects, the present disclosure provides a unit dose laundry detergent product comprising: a water-soluble polymeric film; a detergent composition encapsulated by the water-soluble polymeric film, said detergent composition comprising: (a) at least one anionic surfactant present in the composition in a concentration of about 5% to about 50% (w/w); (b) at least one non-ionic surfactant present in the composition in a concentration of about 2% to about 30% (w/w); (c) at least one cationic cellulosic polymer present in the composition in a concentration of from about 0.05% to about 2.0%; (d) at least one dye transfer inhibitor polymer present in the composition in a concentration of about 0.05% to about 2.0% (w/w); (e) at least one anti-redeposition polymer present in the composition in a concentration of from about 0.05% to about 2.0% (w/w); and (f) water present in the composition in a concentration of about 5% to about 30% (w/w).

In some aspects, the disclosed unit dose further comprises a de-foaming agent, selected from the group consisting of fatty acids derived from palm kernel oil or coconut oil, wherein the de-foaming agent is present in the composition in a concentration of from about 0.10% to about 5.0% (w/w). In some aspects, the disclosed unit dose further comprises sodium hydroxide (caustic) wherein the sodium hydroxide (caustic) is present in the composition in a concentration of about 0.01% (w/w), or about 0.05% (w/w).

In some aspects, the disclosed unit dose further comprises citric acid, wherein the citric acid is present in the composition in a concentration of about 0.5% to about 7.0% (w/w); triethanolamine (TEA), wherein the TEA is present in the composition in a concentration of from about 0.50% to about 1.5% (w/w); calcium chloride, wherein the calcium chloride is present in the composition in a concentration of from about 0.01% (w/w) to about 0.05% (w/w); a chelating agent, wherein the chelating agent is present in the composition in a concentration of from about 0.3% to about 0.5% (w/w); monoethanolamine, wherein the monoethanolamine is present in the composition in a concentration of from about 0.5% to about 1.5% (w/w); and a preservative selected from the group consisting of 5-chloro-2-methyl-2H-isothiazol-3-one and 2-methyl-2H-isothiazol-3-one (CMIT/MIT), benzisothiazolinone (BIT), 2-methyl-4-isothiazolin-3-one, 5-chloro-2-methyl-4-isothiazolin-3-one, 2-methyl-4-isothiazolin-3-one, and combinations thereof, wherein the preservative is present in the composition in a concentration of from 0.001% to about 0.15% (w/w).

In some aspects, the present disclosure provides a method of making a laundry detergent composition comprising: a. mixing water, a surfactant, a defoamer, a neutralizer, a chelating agent, a chorine scavenging agent, a preservative, and a fragrance, b. providing at least one cationic cellulose polymer within a concentration of between about 0.05% to about 2.0% (w/w); c. providing at least one dye transfer inhibitor within a concentration of between about 0.05% to about 2.0% (w/w); and d. providing at least one anti-redeposition polymer within a concentration of between about 0.05% to about 2.0% (w/w); and e. mixing a.-d. to form a mixture.

In some aspects, the present disclosure provides a method of delivering fabric care to one or more laundry articles, comprising contacting the one or more laundry articles with the composition of the present disclosure.

DETAILED DESCRIPTION OF THE INVENTION

Definitions

All of the various aspects, aspects, and options disclosed herein can be combined in any and all variants unless otherwise specified. Terms in this application control in the event of a conflict with a patent or publication term that is incorporated by reference.

As used herein, "a," "an," or "the" means one or more unless otherwise specified.

Open terms such as "include," "including," "contain," "containing," and the like mean "comprising."

The act of treating laundry (e.g., fabric) can refer to, for example, one or more of: i) cleaning a fabric, ii) softening a fabric; iii) applying fragrance to a fabric; iv) providing elasticity to a fabric (v) applying a color protection agent to a fabric, (vi) applying an anti-wrinkling agent to a fabric, (vii) applying an odor capturing agent to a fabric, (viii) applying a fiber protection agent to a fabric, (ix) applying a soil releasing agent to a fabric, (x) applying an optical brightening agent to a fabric, (xi) applying a UV protection agent to a fabric, (xii) applying an anti-pilling agent to a fabric, (xii) applying a water repellency agent to a fabric, (xiii) applying a disinfecting and/or sanitizing agent to a fabric, (xiv) applying a souring agent to a fabric, (xv) applying a repellent to a fabric, and any combination thereof.

Some aspects contemplate numerical ranges. Numerical ranges provided herein include the range endpoints as individual aspects. When a numerical range is provided, all individual values and sub-ranges therein are present as if explicitly provided.

The terms "laundry," "textile," and "fabric" can be used interchangeably.

The terms "fragrance" and "perfume" can be used interchangeably.

The term "about" is synonymous with the term "approximately," and includes the recited number ±10% or ±5%. For example, "about 10" means 9 to 11. Also as an example, a temperature of approximately 50° C. means 45-55° C., or 47.5° C.-52.5° C. Unless indicated otherwise, all percentages indicated are percentage by weight.

The term "at least one," refers to one or more, for example 1, 2, 3, 4, 5, 6, 7, 8, 9 or more. In particular, this information refers to the type of agent/compound and not to the absolute number of molecules. "At least one fragrance" therefore means that at least one type of fragrance is included, but that two or more different types of fragrances can also be included.

The terms "wash cycle" and "washing cycle" can be used interchangeably. The terms "wash cycle" and "washing cycle" refer to one cycle of washing and rinsing a load of laundry in a top or front loading consumer washing machine, which takes place after a consumer sets the washing machine to "on," which immerses the laundry in water.

The term "fabric care" refers to various fabric benefits including smoothness, shape maintenance, resilience, color preservation, and pilling control among others.

The term "conditioning benefits" refers to advantages to fabric fibers in which the fibers have been affected by an agent which helps the fibers to remain smooth and retain elasticity.

The ingredients disclosed herein are provided as (w/w) %. The values and ranges that are provided refer to the mass of an ingredient as a percentage of the total mass of the composition. If an ingredient is provided as an aqueous solution during the process of making a particular composition, the stated values and range only refer to the mass of the ingredient or active. For example, the mass of water in the aqueous solution would count toward the total mass of water in the composition.

Aspects

References to "one aspect," "an aspect," "some aspects," etc., indicate that the aspect(s) described can include a particular feature, structure, or characteristic. Moreover, such phrases are not necessarily referring to the same aspect. Further, when a particular feature, structure, or characteristic is described in connection with an aspect, it is submitted that it is within the knowledge of one skilled in the art to affect such feature, structure, or characteristic in connection with other aspects whether or not explicitly described.

The following examples are illustrative, but not limiting, of the present aspects. Other suitable modifications and adaptations of the variety of conditions and parameters normally encountered in the field, and which would be apparent to those skilled in the art, are within the spirit and scope of the disclosure.

Composition: Three Polymer Blend

In some aspects, the compositions described herein, which include a three-polymer blend of at least one cationic cellulosic polymer, at least one dye transfer inhibitor, and at least one anti-redeposition agent, advantageously provide fabric care benefits to laundry while avoiding a negative impact on fabric resiliency. These benefits are obtained without the need to add an amphoteric surfactant or a silicone together with cationic cellulose. Furthermore, a number of additional benefits can be provided to laundry by washing with the compositions described herein.

Cationic Cellulosic Polymer

Cationic cellulosic polymers can be used in liquid laundry detergents to provide conditioning benefits to fabrics. In some aspects, the composition of the present disclosure can include at cationic cellulosic polymer. In some aspects, the cationic cellulosic polymer can be a cationic modified hydroxyethyl cellulose.

In some aspects, the cationic cellulosic polymer is a quaternised hydroxyethyl cellulose. In some aspects, the cationic cellulosic polymer can include, but is not limited to: cocodimethylammonium hydroxypropyl oxyethyl cellulose, lauryldimethylammonium hydroxypropyl oxyethyl cellulose, stearyldimethylammonium hydroxypropyl oxyethyl cellulose, and stearyldimethylammonium hydroxyethyl cellulose; cellulose 2-hydroxyethyl 2-hydroxy 3-(trimethyl ammonio) propyl ether salt, polyquaternium-4, polyquaternium-10, polyquaternium-24 and polyquaternium-67 or mixtures thereof.

In some aspects, the presently disclosed composition can include cationic hydroxyethyl cellulose (HEC) polymers In some aspects, the cationic cellulosic polymer can be present in the composition in a concentration of from about 0.05% to about 2.0% (w/w). In some aspects, the cationic cellulosic polymer is present in the composition in a concentration of from about 0.05% to about 1.5% (w/w), or from about 0.05% to about 1.0% (w/w), or from about 0.1% to about 1.5% (w/w), or from about 0.1% to about 1.0% (w/w), or a range between any two of the preceding values. In one aspect, the cationic cellulosic polymer can be present in the composition in a concentration of from about 0.1% to about 0.75% (w/w).

Dye Transfer Inhibitor

Dye transfer inhibitors (DTIs) are typically used to prevent dye from dissolving or transferring to other fabrics during washing and/or cleaning of dyed fabrics.

In some aspects, the composition of the present disclosure can include at least one DTI. Suitable DTIs include but are not limited to: poly-N-vinylpyrrolidone (PVP), poly-4-vinylpyridine-N-oxide (PVNO), N-vinylpyrrolidone and N-vinylimidazole (PVPVI), vinylpyrrolidone/vinylimidazole (PVP/PVI), their copolymers, and mixtures thereof.

In some aspects, the DTI of the presently disclosed composition can be a vinylpyrrolidone/vinylimidazole (PVP/PVI) copolymer in granule format. A commercially available DTI that is suitable for the composition of the present disclosure is SOKALAN® HP56, vinylpyrrolidone/vinylimidazole (PVP/PVI) copolymer (BASF, Ludwigshafen, Germany).

In some aspects, the DTI can be present in the composition in a concentration of from about 0.05% to about 2.0% (w/w). In some aspects, the DTI is present in the composition in a concentration of from about 0.05% to about 1.5% (w/w), or from about 0.05% to about 1.0% (w/w), or from about 0.1% to about 1.5% (w/w), or from about 0.1% to about 1.0% (w/w), or a range between any two of the preceding values. In one aspect, the DTI can be present in the composition in a concentration of from about 0.1% to about 0.75% (w/w).

Anti-Redeposition Agent

Anti-redeposition agents are typically used to keep soil dispersed in the wash water of a washing machine, thereby preventing soil from re-depositing onto the fabrics being laundered. More specifically, anti-redeposition agents are dispersion polymers with a soil detachment capacity, which are also known as "soil repellents" due to their ability to provide a soil-repelling finish on the surface of laundered fabrics.

In some aspects, the present composition can include at least one anti-redeposition agent. Suitable anti-redeposition agents include but are not limited to: polyacrylate, polymethylacrylate, methylacrylate styrene copolymers, sodium methylacrylate styrene copolymers, and mixtures thereof. In some aspects, suitable anti-redeposition agents include homopolymers of acrylic acid. A commercially available anti-redeposition agent that is suitable for the composition of the present disclosure is ACUSOL™ 445 homopolymer of acrylic acid (Dow Chemical Co., Midland, Mich.).

In some aspects, the anti-redeposition agent can be present in the composition in a concentration of from about 0.05% to about 2.0% (w/w). In some aspects, the anti-redeposition agent is present in the composition in a concentration of from about 0.05% to about 1.5% (w/w), or from about 0.1% to about 1.0% (w/w), or from about 0.1% to about 1.0% (w/w), or a range between any two of the preceding values. In one aspect, the anti-redeposition agent can be present in the composition in a concentration of from about 0.1% to about 0.85% (w/w).

In some aspects, the compositions disclosed herein include a three-polymer blend comprising:

A laundry detergent composition comprising: at least one cationic cellulosic polymer in a concentration of from about 0.1% to about 0.75% (w/w); at least one dye transfer inhibitor in a concentration of from about 0.1% to about 0.75% (w/w); and at least one anti-redeposition agent in a concentration of from about 0.1% to about 0.85% (w/w); and further comprising at least one additional beneficial agent.

Additional Beneficial Agents

In some aspects, the composition of the present disclosure may comprise some or all of the ingredients listed below.

Surfactant(s)

In some aspects, the composition of the present disclosure further comprises at least one anionic surfactant.

In some aspects, the composition of the present disclosure comprises two or more anionic surfactants, i.e., first and second anionic surfactants. In some aspects, the two or more anionic surfactants are present in the composition in a combined concentration of about 2% to about 30% (w/w). In some aspects, the two or more anionic surfactants are present in the composition in a combined concentration of about 3% to about 30% (w/w).

In some aspects, the at least one anionic surfactant, i.e., the first and second anionic surfactants, can include but are not limited to: alkylbenzene sulfonic acids, alkyl ether sulfates, polyethoxylated alcohol sulfates, sodium lauryl ether sulfates, alkali metal salts of $C_{10}$-$C_{16}$ alkyl benzene sulfonic acids, linear alkyl benzene sulfonates, sodium and potassium linear, straight chain alkylbenzene sulfonates, and α-sulfofatty acid esters, ethoxysulfates, such as, for example, C12-15 ethoxysulfate (alcohol ethoxysulfate) 3EO, and any combination thereof.

In some aspects, the first anionic surfactant can be present in the composition in a concentration of about 0.5% to about 12% (w/w), or from about 0.5% to about 8%, or from about 0.5% to about 4%, or from about 1.0% to about 12%, or from about 1.0% to about 8%, or from about 1.0% to about 5%. In one aspect, the first anionic surfactant can be present in the composition in a concentration of from about 1.0% to about 4%.

In some aspects, the second anionic surfactant is present in the composition in a concentration of from about 0.5% to 20% (w/w), or from about 0.5% to 15% (w/w), 0.5% to 10% (w/w), or from about 1.0% to 15% (w/w), or from about 1.0% to 10% (w/w) In some aspects, the second anionic surfactant is present in the composition in a concentration of from about 1.0% to about 9.0%.

In some aspects, the two or more anionic surfactants are present in the composition in a combined concentration of about 2% to about 30% (w/w). In some aspects, the two or more anionic surfactants are present in the composition in a combined concentration of about 3% to about 30% (w/w).

In some aspects, the composition of the present disclosure further comprises a non-ionic surfactant. In some aspects, the non-ionic surfactant can include but is not limited to: alkoxylated fatty alcohols, ethylene oxide (EO)-propylene oxide (PO) block polymers, amine oxide surfactants, alcohol alkoxylates, $C_{12}$-$C_{15}$ alcohol ethoxylates, ethoxylated or ethoxylated and propoxylated, fatty acid alkyl esters, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides.

In some aspects, the non-ionic surfactant is present in the composition in a concentration of from about 1% to about 20% (w/w), or from about 2% to about 20% (w/w), or from about 3% to about 20% (w/w), or from about 1% to about 15% (w/w), or from about 1% to about 10% (w/w), or from about 2% to about 15% (w/w), or from about 2% to about 10% (w/w). In one aspect, the non-ionic surfactant is present in the composition in a concentration of from about 2% to about 9.0%.

In some aspects, the composition of the present disclosure further comprises a surfactant which is a de-foaming agent. In some aspects, the de-foaming agent can be free fatty acids derived from palm kernel oil or coconut oil.

In some aspects, the de-foaming agent is present in the composition in a concentration of from about 0.10% to about 5.0% (w/w), or from about 0.25% to about 5.0% (w/w), or from about 0.3% to about 1.0% (w/w), or from about 0.3%. In one aspect, the de-foaming agent is present in the composition in a concentration of from about 0.3% to about 3.0%.

Builder(s)

In some aspects, the composition of the present disclosure further comprises a builder. Builders can be included in laundry detergents to counteract the detrimental effects of hardness ions (Ca2+ and Mg2+) which arise in the wash solution from the water used to fill the washing machine. In some aspects, the builder can be citric acid. In some aspects, the builder is present in the composition in a concentration of about 0.5% to about 7.0% (w/w), or about 0.5% to about 5.0% (w/w), or from about 1.0% to about 5.0% (w/w), or from about 1.5% to about 5.0% (w/w), or from about 1.5% to about 4.0% (w/w). In one aspect, the builder is present in the composition in a concentration of about 1.0% (w/w), or about 1.5% (w/w), or about 2.0% (w/w), or about 2.5% (w/w).

In some aspects, the composition of the present disclosure further comprises a builder that is a hydrotrope. Hydrotropes can be added to liquid laundry detergents to help solubilize hydrophobic compounds in aqueous solutions. In some aspects, the hydrotrope can be triethanolamine (TEA). In some aspects, the TEA is present in the composition in a concentration of from about 0.50% to about 1.5% (w/w), or about 1.0% (w/w), or about 1.5% (w/w).

In some aspects, the composition of the present disclosure further comprises a builder that is an enzyme stabilizer. In some aspects, the enzyme stabilizer can be calcium chloride. In some aspects, the calcium chloride is present in the composition in a concentration of from about 0.01% to about 0.05% (w/w).

Neutralizer(s)

In some aspects, the composition of the present disclosure further comprises a neutralizer. Suitable neutralizers include, e.g., sodium hydroxide (caustic) and monoethanolamine. In some aspects, the sodium hydroxide (caustic) is present in the composition in a concentration of from about 0.5% to 5% (w/w), or from about 0.5% to 3% (w/w), or from about 0.75% to 3% (w/w). In some aspects, the sodium hydroxide (caustic) is present in the composition in a concentration of from about 0.75% to 2.5% (w/w). In some aspects, the monoethanolamine is present in the composition in a concentration of from about 0.5% to about 1.5% (w/w), or about 0.5% (w/w), or about 1.0% (w/w), or about 1.50% (w/w).

Chelating Agent(s)

In some aspects, the composition of the present disclosure further comprises a chelating agent, such as, e.g., iminodisuccinic acid. In some aspects, the chelating agent is present in the composition in a concentration of from about 0.3% to about 0.5% (w/w), or about 0.3% (w/w), or about 0.4% (w/w), or about 0.5% (w/w), or about 0.6% (w/w).

Preservative(s)

In some aspects, the composition of the present disclosure further comprises a preservative. In some aspects, the preservative can include but is not limited to: 5-chloro-2-methyl-2H-isothiazol-3-one and 2-methyl-2H-isothiazol-3-one (CMIT/MIT), benzisothiazolinone (BIT), 2-methyl-4-isothiazolin-3-one, 5-chloro-2-methyl-4-isothiazolin-3-one, 2-methyl-4-isothiazolin-3-one, and combinations thereof.

In some aspects, the preservative is present in the composition in a concentration of from about 0.001% to about 0.15% (w/w). In some aspects, the preservative is present in the composition in a concentration of from about 0.010% (w/w) to about 0.015% (w/w).

Fragrance(s)

In some aspects, the composition of the present disclosure further comprises a fragrance. In some aspects, the fragrance is an oil fragrance or an encapsulated fragrance.

In some aspects, the fragrance is present in the composition in a concentration of from about 0.10% (w/w) to about 3.0% (w/w).

Water

In some aspects, the composition of the present disclosure further comprises water.

In some aspects, water is present in the composition in a concentration of from about 20% to about 95% (w/w), or from about 30% to about 95% (w/w), or from about 30% to about 94% (w/w), or from about 35% to about 95%, or from about 35% to about 94%, or from about 35% to about 96%, or from about 40% to about 96%, or from about 40% to about 94%. In one aspect, water is present in the composition in a concentration of from about 40% to about 92% (w/w).

Additional Agent(s)

In some aspects, the composition of the present disclosure further comprises at least one additional agent selected from the group consisting of: an anti-wrinkling agent, an odor capturing agent, a fiber protection agent, a color protection agent, a soil releasing agent, an optical brightening agent, a UV protection agent, an anti-pilling agent, a water repellency agent, a disinfecting, a sanitizing agent, a souring agent, a repellent, and mixtures thereof.

Any additional beneficial agents for typically used for liquid laundry detergents are contemplated as suitable for use in the presently disclosed compositions.

Methods of Making and Using

Methods of making the presently disclosed compositions are further contemplated. In some aspects, a method of making a composition for fabric treatment, comprises mixing:

a. at least one cationic cellulose polymer,
b. at least one dye transfer inhibitor polymer,
c. at least one anti-redeposition polymer,
d. water,
e. a surfactant,
f. a defoamer, and
g. a neutralizer together in a batch, and agitating the mixture.

In some aspects, methods of making the presently disclosed compositions further include a. mixing water, surfactant, defoamer, a neutralizer, a chelating agent, a chorine scavenging agent, a preservative, and a fragrance, and
b. providing the at least one cationic cellulose polymer within a concentration of between about 0.05% to about 2.0% (w/w %);
c. providing the at least one dye transfer inhibitor within a concentration of between about 0.05% to about 2.0% (w/w %); and
d. providing the at least one anti-redeposition polymer within a concentration of between about 0.05% to about 2.0% (w/w %);
e. mixing a.-d. to form a mixture.

In some aspects, the present disclosure provides a method of delivering fabric care to laundry comprising contacting the fabrics in the laundry with the presently disclosed compositions.

Unit Dose Pac—Container

In some aspects, the present disclosure provides a unit dose comprising a container and a liquid composition. The container may be a pouch or a pack (or pac) that comprises a water-soluble or water-dispersible film, which fully encloses the liquid composition in at least one compartment. In some embodiments, the pouch or the pac comprises two compartments. The unit dose composition is suitable for containing the compositions for fabric care disclosed herein.

The water-soluble or water-dispersible container of the present disclosure may be in any desirable shape and size, e.g., square, rectangular, oval, elliptoid, superelliptical, or circular shape. Suitable unit dose pacs and unit dose containers are discussed in U.S. Patent Application Publication Number 2019/0233768, which is herein incorporated by reference in its entirety.

In some aspects, the unit dose of the present disclosure can be a unit dose laundry detergent product including: a water-soluble polymeric film; a detergent composition encapsulated by the water-soluble polymeric film, said detergent composition comprising: (a) at least one anionic surfactant present in the composition in a concentration of about 5% to about 50% (w/w); (b) at least one non-ionic surfactant present in the composition in a concentration of about 2% to about 30% (w/w); (c) at least one cationic cellulosic polymer present in the composition in a concentration of from about 0.05% to about 2.0%; (d) at least one dye transfer inhibitor polymer present in the composition in a concentration of about 0.05% to about 2.0% (w/w); (e) at least one anti-redeposition polymer present in the composition in a concentration of from about 0.05% to about 2.0% (w/w); and (f) water present in the composition in a concentration of about 5% to about 30% (w/w).

In some aspects, the unit dose of the present disclosure comprises at least one anionic surfactant. Suitable anionic surfactants are described elsewhere herein.

In some aspects, the at least one anionic surfactant is present in the unit dose in a concentration of about 5% to about 50% (w/w). In some aspects, the unit dose of the present disclosure comprises two or more anionic surfactants, i.e., first and second anionic surfactants. In some aspects, the two or more anionic surfactants are present in the composition in a combined concentration of about 5% to about 50% (w/w).

In some aspects, the at least one anionic surfactant is present in the unit dose in a concentration of about 5% to about 45% (w/w), or from of about 10% to about 45% (w/w), or from of about 10% to about 45% (w/w), or from of about 15% to about 45% (w/w), or from of about 20% to about 45% (w/w), or from of about 18% to about 45% (w/w), or from of about 18% to about 40% (w/w). In one aspect, the at least one anionic surfactant is present in the unit dose composition in a concentration of about 20% to about 40% (w/w).

In some aspects, the unit dose of the present disclosure comprises at least one non-ionic surfactant. Suitable non-ionic surfactants for the disclosed unit dose are described elsewhere herein.

In some aspects, the non-ionic surfactant is present in the unit dose in a concentration of from about 2% to about 30% (w/w), by weight of the anionic surfactant in the detergent composition or from of about 5% to about 30% (w/w), or from of about 10% to about 30% (w/w), or from of about 15% to about 30.0% (w/w), or from of about 20% to about 30.0% (w/w). In one aspect, the non-ionic surfactant is present in the composition in a concentration of from about 20% to about 25%.

Cationic Cellulosic Polymer

In some aspects, the unit dose of the present disclosure can include a cationic cellulosic polymer. Suitable cationic cellulosic polymers are described elsewhere herein.

In some aspects, the cationic cellulosic polymer can be present in the unit dose in a concentration of from about 0.05% to about 2.0% (w/w). In some aspects, the cationic cellulosic polymer is present in the composition in a concentration of from about 0.05% to about 1.5% (w/w), or from about 0.05% to about 1.0% (w/w), or from about 0.1% to about 1.5% (w/w), or from about 0.1% to about 1.0% (w/w), or a range between any two of the preceding values. In one aspect, the cationic cellulosic polymer can be present in the composition in a concentration of from about 0.1% to about 0.75% (w/w).

Dye Transfer Inhibitor

In some aspects, the unit dose of the present disclosure can include DTI. Suitable DTIs are described elsewhere herein.

In some aspects, the DTI can be present in the composition in a concentration of from about 0.05% to about 2.0% (w/w). In some aspects, the DTI is present in the composition in a concentration of from about 0.05% to about 1.5% (w/w), or from about 0.05% to about 1.0% (w/w), or from about 0.1% to about 1.5% (w/w), or from about 0.1% to about 1.0% (w/w), or a range between any two of the preceding values. In one aspect, the DTI can be present in the composition in a concentration of from about 0.1% to about 0.75% (w/w).

Anti-Redeposition Agent

In some aspects, the unit dose of the present disclosure can include an anti-redeposition agent. Suitable anti-redeposition agents are described elsewhere herein.

In some aspects, the anti-redeposition agent can be present in the composition in a concentration of from about 0.05% to about 2.0% (w/w), based on the weight of the active ingredient. In some aspects, the anti-redeposition agent is present in the composition in a concentration of from about 0.05% to about 1.5% (w/w), or from about 0.1% to about 1.0% (w/w), or from about 0.1% to about 1.0% (w/w), or a range between any two of the preceding values. In one aspect, the anti-redeposition agent can be present in the composition in a concentration of from about 0.1% to about 0.75% (w/w).

In some aspects, the unit dose of the present disclosure further comprises water.

In some aspects, water is present in the composition in a concentration of from about 1.0% to about 30.0% (w/w), or from about 5% to about 30% (w/w), or from about 5% to about 20% (w/w), or from about 5% to about 20%. In one aspect, water is present in the composition in a concentration of from about 9.0% to about 18.0% (w/w).

Additional Beneficial Agents

In some aspects, the unit dose of the present disclosure may comprise some or all of the additional beneficial agents described elsewhere herein.

The compositions of the present disclosure can be used to treat fabrics or textiles, for example, to impart softness, to impart scent (i.e., apply fragrance to), to provide smoothness, to maintain shape, fabric recovery, color preservation, pilling control, fabric strength, etc. when the fabric is laundered in a washing machine.

In some aspects, the compositions can be used in a top loading or front loading washing machine, in hot, warm, or cold water.

In some aspects, the composition can be added to an amount of water or wash water in which a fabric is washed by hand.

The following examples are illustrative and do not limit the scope of the disclosure of the claims.

EXAMPLE

The following table provides exemplary formulations according to aspects described herein.

TABLE 1

| | | w/w (%) | | | | |
|---|---|---|---|---|---|---|
| | | Formula Name | | | | |
| Ingredient | % Activity of ingredient | P1 Comparative | P2 Example 1 | P3 Example 2 | P4 Example 3 | P5 (3-polymer blend) Example 4 |
| Water | 100% | 73.65 | q.s. | q.s. | q.s. | q.s. |
| Citric Acid | 50% | 5.00 | 5.00 | 5.00 | 5.00 | 5.00 |
| NaOH (Caustic) | 50% | 1.92 | 1.92 | 1.92 | 1.92 | 1.92 |
| Triethanolamine (TEA) | 85% | 1.01 | 1.01 | 1.01 | 1.01 | 1.01 |
| Linear Alkylbenzene Sulfonic Acid (LAS) | 96% | 1.82 | 1.82 | 1.82 | 1.82 | 1.82 |
| Coconut Fatty Acid | 100% | 0.50 | 0.50 | 0.50 | 0.50 | 0.50 |
| C12-C15 Alcohol Ethoxylate 7EO | 100% | 6.80 | 6.80 | 6.80 | 6.80 | 6.80 |
| C12-C15 Ethoxysulfate (Alcohol Ethoxysulfate) 3EO | 60% | 6.67 | 6.67 | 6.67 | 6.67 | 6.67 |
| Calcium Chloride | 95% | 0.05 | 0.05 | 0.05 | 0.05 | 0.05 |
| Chelating Agent | 34% | 1.47 | 1.47 | 1.47 | 1.47 | 1.47 |
| Monoethanolamine | 100% | 1.00 | 1.00 | 1.00 | 1.00 | 1.00 |
| Preservative | ~10% | 0.11 | 0.11 | 0.11 | 0.11 | 0.11 |
| Homopolymer of acrylic acid | 45% | — | — | 0.56 | — | 0.56 |

TABLE 1-continued

| | w/w (%) | | | | | |
|---|---|---|---|---|---|---|
| | | Formula Name | | | | |
| Ingredient | % Activity of ingredient | P1 Comparative | P2 Example 1 | P3 Example 2 | P4 Example 3 | P5 (3-polymer blend) Example 4 |
| Vinylpyrrolidone/ Vinylimidazole copolymer | 97-100% | — | — | — | 0.21 | 0.21 |
| Cationic hydroxethyl cellulose (HEC) polymer | 91% | — | 0.60 | 0.60 | 0.60 | 0.60 |
| Total | 100.00 | 100.00 | 100.00 | 100.00 | 100.00 | 100.00 |

The amounts listed in Table 1 are the as-supplied amounts. The percent of each ingredient by weight of the active ingredient can be calculated by multiplying the amount by the % activity. The ingredients are provided as (w/w) %. The values and ranges that are provided refer to the mass of an ingredient, e.g. sodium hydroxide, as a percentage of the total mass of the composition. If an ingredient is provided as an aqueous solution during the process of making a particular composition, the stated values and range only refer to the mass of the ingredient or active. The mass of water in the aqueous solution would count toward the total mass of water in the composition. Suitable percentages of the at least one cationic cellulosic polymer, at least one dye transfer inhibitor, and at least one anti-redeposition agent, are disclosed elsewhere herein.

Resilience Test

A resilience test was designed to determine the resilience effects on fabric samples after treatment of the fabrics with the compositions of the present disclosure. Briefly, the above ingredients were batched and dosed at 62 grams per dose. The doses were inserted into standard top loader washing machines with the following parameters: wash water was 90° F., 120 ppm total of $CA^{++}$ and $Mg^{++}$, and 0 ppm of chlorine. About six pounds total of ballast and cotton textiles (Cotton 460 and Cotton 428, 2-3 replicates per fabric type) were used to simulate consumer laundry loads. Each load of ballast was washed five times. After five washes, the fabrics were dried and the resilience of the Cotton 460 fabrics was tested on a Phabrometer instrument (Nu Cybertek, Davis, Ca). The results of the resilience test is set forth below in Table 2.

TABLE 2

| Formula | Statistical level | Fabric Resilience Score |
|---|---|---|
| P5 (3-polymer blend) | A | 55.23 |
| P4 | B | 54.26 |
| P3 | B | 54.25 |
| P2 | B | 54.22 |
| P1 | C | 53.60 |

The first column provides the tested formula. The second column indicates the statistical category of the fabric sample. Fabric samples without a shared letter (e.g., A, B, and C) are statistically different from each other. The third column provides the resilience score of the sample fabric as measured by the Phabrometer. A higher resilience score indicates more resilient fabric samples.

The results shown in Table 2 confirm that there is a statistical difference in the resilience of fabrics washed with P5 (statistical level A), as compared to the resilience of fabrics washed with either P4, P3, or P2 (statistical level B). In order to achieve the statistically significant resilience benefit, all three polymers (cationic cellulosic polymer, dye transfer inhibitor polymer, and anti-redeposition polymer) were needed in the formulation. As set forth in Table 2, formulas with one or two of the cationic cellulosic polymer, dye transfer inhibitor polymer, and anti-redeposition polymer, did not provide a statistically significant benefit. The fabrics washed with P1, the comparative formulation had the lowest resiliency (statistical level C).

This example demonstrates that the addition of the presently disclosed composition provides a statistically significant level of resilience to the sample fabrics.

It will be understood by those of ordinary skill in the art that the same can be performed within a wide and equivalent range of conditions, formulations and other parameters without affecting the scope of the disclosure or any aspect thereof. All patents, patent applications, and publications cited herein are fully incorporated by reference herein in their entirety.

The foregoing description of the specific aspects has revealed the general nature of the disclosure such that others can, by applying knowledge within the skill of the art, readily modify and/or adapt for various applications such specific aspects, without undue experimentation, without departing from the general concept of the present disclosure. Therefore, such adaptations and modifications are intended to be within the meaning and range of equivalents of the disclosed aspects, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A fabric care laundry detergent composition, comprising:

(a) at least one anionic surfactant present in the composition in a concentration of about 2% to about 30% (w/w);

(b) at least one non-ionic surfactant present in the composition in a concentration of about 2% to about 30% (w/w);

(c) at least one cationic cellulosic polymer present in the composition in a concentration of from about 0.05% to about 2.0% (w/w);

(d) at least one dye transfer inhibitor polymer present in the composition in a concentration of about 0.1% to about 1.0% (w/w);

(e) at least one anti-redeposition polymer present in the composition in a concentration of about 0.05% to about 2.0% (w/w), wherein the at least one anti-redeposition agent is a homopolymer of acrylic acid; and (f) water present in the composition in a concentration of about 30% to about 95% (w/w);

wherein said detergent composition is free of silicone.

2. The composition of claim 1, wherein the at least one anionic surfactant is selected from the group consisting of alkylbenzene sulfonic acids, alkyl ether sulfates, polyethoxylated alcohol sulfates, sodium lauryl ether sulfates, alkali metal salts of $C_{10}$-$C_{16}$ alkyl benzene sulfonic acids, linear alkyl benzene sulfonates, sodium and potassium linear, straight chain alkylbenzene sulfonates, a-sulfofatty acid esters, ethoxysulfates, and combinations thereof.

3. The composition of claim 1, wherein the non-ionic surfactant is selected from the group consisting of alkoxylated fatty alcohols, ethylene oxide (EO)-propylene oxide (PO) block polymers, amine oxide surfactants, alcohol alkoxylates, $C_{12}$-$C_{15}$ alcohol ethoxylates, ethoxylated or ethoxylated and propoxylated, fatty acid alkyl esters, polyalkoxylated alkanolamides, polyoxyalkylene alkyl ethers, polyoxyalkylene alkylphenyl ethers, polyoxyalkylene sorbitan fatty acid esters, polyoxyalkylene sorbitol fatty acid esters, polyalkylene glycol fatty acid esters, alkyl polyalkylene glycol fatty acid esters, polyoxyethylene polyoxypropylene alkyl ethers, polyoxyalkylene castor oils, polyoxyalkylene alkylamines, glycerol fatty acid esters, alkylglucosamides, alkylglucosides, and alkylamine oxides.

4. The composition of claim 1, wherein the at least one cationic cellulosic polymer is a cationic hydroxyethyl cellulose polymer.

5. The composition of claim 1, wherein the at least one dye transfer inhibitor polymer is selected from the group consisting of poly-N-vinylpyrrolidone (PVP), poly-4-vinylpyridine-N-oxide (PVNO), N-vinylpyrrolidone and N-vinylimidazole (PVPVI), or their copolymers, and mixtures thereof.

6. The composition of claim 1, further comprising a de-foaming agent, selected from the group consisting of fatty acids derived from palm kernel oil or coconut oil, wherein the de-foaming agent is present in the composition in a concentration of from about 0.10% to about 5.0% (w/w).

7. The composition of claim 1, further comprising citric acid, wherein the citric acid is present in the composition in a concentration of about 0.5% to about 7.0% (w/w).

8. The composition of claim 1, further comprising sodium hydroxide wherein the sodium hydroxide is present in the composition in a concentration of about 0.01% (w/w), or about 0.05% (w/w).

9. The composition of claim 1, further comprising triethanolamine (TEA), wherein the TEA is present in the composition in a concentration of from about 0.50% to about 1.5% (w/w).

10. The composition of claim 1, further comprising calcium chloride, wherein the calcium chloride is present in the composition in a concentration of from about 0.01% (w/w) to about 0.05% (w/w).

11. The composition of claim 1, further comprising a chelating agent, wherein the chelating agent is present in the composition in a concentration of from about 0.3% to about 0.5% (w/w).

12. The composition of claim 1, further comprising monoethanolamine, wherein the monoethanolamine is present in the composition in a concentration of from about 0.5% to about 1.5% (w/w).

13. The composition of claim 1, further comprising a preservative selected from the group consisting of 5-chloro-2-methyl-2H-isothiazol-3-one and 2-methyl-2H-isothiazol-3-one (CMIT/MIT), benzisothiazolinone (BIT), 2-methyl-4-isothiazolin-3-one, 5-chloro-2-methyl-4-isothiazolin-3-one, 2-methyl-4-isothiazolin-3-one, and combinations thereof, wherein the preservative is present in the composition in a concentration of from 0.001% to about 0.15% (w/w).

14. The composition of claim 1, further comprising a fragrance, wherein the fragrance is present in the composition in a concentration of from 0.10% (w/w) to about 3.0% (w/w).

15. A fabric care laundry detergent composition comprising:

at least one cationic cellulosic polymer in a concentration of from about 0.1% to about 0.75% (w/w), wherein the at least one cationic cellulosic polymer is a cationic hydroxyethyl cellulose polymer;

at least one dye transfer inhibitor in a concentration of from about 0.1% to about 0.75% (w/w), wherein the at least one dye transfer inhibitor is a vinylpyrrolidone and vinylimidazole copolymer; and at least one anti-redeposition agent in a concentration of from about 0.1% to about 0.85% (w/w), wherein the at least one anti-redeposition agent is a homopolymer of acrylic acid;

and further comprising at least one additional beneficial agent, wherein the composition is free of silicone.

16. A unit dose laundry detergent product comprising:

a water-soluble polymeric film;

a fabric care detergent composition encapsulated by the water-soluble polymeric film, said detergent composition comprising:

(a) anionic surfactant present in the composition in a concentration of about 5% to about 50% (w/w), the anionic surfactant consisting of linear alkylbenzene sulfonic acid and alcohol ethoxysulfate;

(b) at least one alcohol ethoxylate non-ionic surfactant present in the composition in a concentration of about 2% to about 30% (w/w);

(c) at least one cationic hydroxyethyl cellulosic polymer present in the composition in a concentration of about 0.05% to about 2.0%;

(d) at least one dye transfer inhibitor polymer present in the composition in a concentration of about 0.1% to about 1.0% (w/w), wherein the at least one dye transfer inhibitor is a vinylpyrrolidone and vinylimidazole copolymer;

(e) at least one anti-redeposition polymer present in the composition in a concentration of about 0.05% to about 2.0% (w/w), wherein the at least one anti-redeposition agent is a homopolymer of acrylic acid; and (f) water present in the composition in a concentration of about 5% to about 30% (w/w);

wherein the composition is free of silicone.

17. The unit dose of claim 16, further comprising a de-foaming agent, selected from the group consisting of fatty acids derived from palm kernel oil or coconut oil, wherein the de-foaming agent is present in the composition in a concentration of from about 0.10% to about 5.0% (w/w).

18. The unit dose of claim 16, further comprising sodium hydroxide wherein the sodium hydroxide is present in the composition in a concentration of about 0.01% (w/w), or about 0.05% (w/w).

19. The unit dose of claim 16, further comprising citric acid, wherein the citric acid is present in the composition in a concentration of about 0.5% to about 7.0% (w/w);

triethanolamine (TEA), wherein the TEA is present in the composition in a concentration of about 0.50% to about 1.5% (w/w);

calcium chloride, wherein the calcium chloride is present in the composition in a concentration of about 0.01% (w/w) to about 0.05% (w/w);

a chelating agent, wherein the chelating agent is present in the composition in a concentration of about 0.3% to about 0.5% (w/w);

monoethanolamine, wherein the monoethanolamine is present in the composition in a concentration of about 0.5% to about 1.5% (w/w), and a preservative selected from the group consisting of 5-chloro-2-methyl-2H-isothiazol-3-one and 2-methyl-2Hisothiazol-3-one (CMIT/MIT), benzisothiazolinone (BIT), 2-methyl-4-isothiazolin-3-one, 5-chloro-2-methy 1-4-isothiazolin-3-one, 2-methyl-4-isothiazolin-3-one, and combinations thereof, wherein the preservative is present in the composition in a concentration of 0.001% to about 0.15% (w/w).

* * * * *